US005929815A

United States Patent [19]

Elderfield

[11] Patent Number: 5,929,815

[45] Date of Patent: Jul. 27, 1999

[54] ANTENNA CONNECTOR AND METHOD FOR MAKING AN ELECTRICAL DEVICE

[75] Inventor: David Elderfield, Calgary, Canada

[73] Assignee: Sierra Wireless, Inc., Canada

[21] Appl. No.: 08/994,930

[22] Filed: Dec. 19, 1997

[51] Int. Cl.[6] ..... H01Q 1/24

[52] U.S. Cl. ..... 343/702; 343/906; 439/916

[58] Field of Search ..... 343/702, 906; 439/98, 916, 584, 610; 455/89, 90

[56] References Cited

U.S. PATENT DOCUMENTS

| | | | |
|---|---|---|---|
| 5,276,454 | 1/1994 | Gonzalez et al. | 343/906 |
| 5,524,284 | 6/1996 | Marcou et al. | 343/702 |
| 5,616,043 | 4/1997 | Liou | 439/322 |

*Primary Examiner*—Don Wong
*Assistant Examiner*—Tan Ho
*Attorney, Agent, or Firm*—Burns, Doane, Swecker & Mathis LLP

[57] ABSTRACT

An antenna connector includes a body portion having an opening extending therethrough, a flange extending from a first side of the body portion in a direction substantially perpendicular to a direction of an axis of the opening, and one or more ground pins extending from a third side of the body portion in the direction of the axis of the opening. The antenna connector further includes a coaxial pin member extending through and secured to the opening in the body portion, the coaxial pin member including a pin portion extending outwardly from the opening in a direction of and parallel to the one or more ground pins.

15 Claims, 5 Drawing Sheets

ANTENNA CONNECTOR AND METHOD FOR MAKING AN ELECTRICAL DEVICE

FIELD OF THE INVENTION

The present invention relates to an antenna connector for an electrical device and, more particularly, to an antenna connector having one or more flanges.

BACKGROUND OF THE INVENTION

In structures in which two items are soldered, brazed, or otherwise welded together, and in which one of the items tends to have stresses applied to it, there is a tendency for the items to disconnect at the connection point. In electrical devices having pivotable antennas, the antenna tends to be pivotable about a pivot point and is connected by means of a coaxial pin and grounding pin arrangement to a printed circuit board mounted in a housing. When the antenna is pivoted relative to the housing, the connections between the pins and the printed circuit board are torqued, which may tend to weaken or break them. Further, because the connections tend to be parallel to the pivot axis of the antenna, forces perpendicular to the pivot axis will tend to weaken or break the connections.

A typical electrical device with a pivotable antenna has a housing in which a printed circuit board is mounted. A conductive body with an opening extending therethrough has grounding pins that are soldered to the printed circuit board. A coaxial pin extends through the opening and is insulated from the body by an insulator. One end of the coaxial pin is soldered to the printed circuit board, and the antenna pivots around the other end of the coaxial pin. When a torque is applied to the antenna by pivoting it, the connections between the coaxial pin and the grounding pins are stressed and may become broken. Similarly, when a force that is non-parallel to the pivot axis is applied to the antenna, there will be a tendency for the connections to be stressed. It is desirable to reduce the stress concentrations in connections between antennas and printed circuit boards in electrical devices.

SUMMARY OF THE INVENTION

It is an object of the present invention to provide an electrical device and a method for making an electrical device wherein stress concentrations in connections between antennas and printed circuit boards are minimized. This and other objects are achieved according to the present invention.

According to one aspect of the present invention, an antenna connector is disclosed. The antenna connector includes a body portion having an opening extending therethrough, a flange extending from a side of the body portion in a direction substantially perpendicular to an axis of the opening, and one or more ground pins extending from another side of the body portion in the direction of the axis of the opening. The antenna connector further includes a coaxial pin member extending through and secured to the opening in the body portion, the coaxial pin member including a pin portion extending outwardly from the opening in a direction of and parallel to the one or more ground pins.

According to another aspect of the present invention, an electrical device is disclosed. The electrical device includes an antenna, the antenna having a first coaxial pin member. The electrical device further includes a printed circuit board, and a frame, the printed circuit board being attached to the frame, the frame including a recess. The electrical device further includes an antenna connector, the antenna connector including a conductive body portion having an opening extending therethrough, and a flange extending from a side of the body portion in a direction substantially perpendicular to a direction of the opening, the flange having an opening therein. The antenna connector also includes one or more ground pins extending from the body portion in a direction substantially perpendicular to the flange, a second coaxial pin member extending through and secured to the opening in the body portion, the second coaxial pin member including a pin portion extending outwardly from the opening in a direction of and parallel to the one or more ground pins, and an outer conductor extending outwardly from the opening in a direction opposite the ground pins. The antenna connector is received in the recess of the frame and aligns with the frame such that the opening in the flange aligns with an opening in the frame. At least one of the opening in the flange and the opening in the frame is threaded. The electrical device further includes a threaded fastener, the threaded fastener extending through the opening in the frame and the opening in the flange and securing the flange of the antenna connector to a corresponding surface of the recess in the frame. The pin portion and the ground pins are conductively secured to the printed circuit board. The first coaxial pin member is detachably and rotatably secured to the second coaxial pin member.

An electrical connection obtained between the antenna connector and the frame is an integral part of RF shielding provided by the frame and an external shield.

According to yet another embodiment of the present invention, a method for making an electrical device is disclosed. According to the method, an antenna connector is secured to a printed circuit board. The antenna connector includes a conductive body portion having an opening extending therethrough, a flange extending from a side of the body portion in a direction substantially perpendicular to a direction of the opening, the flange having an opening therein, and one or more ground pins extending from the body portion in a direction substantially perpendicular to the flange. The antenna connector further includes a coaxial pin member extending through and secured to the opening in the body portion, the coaxial pin member including a pin portion extending outwardly from the opening in a direction of and parallel to the one or more ground pins, and an outer conductor extending outwardly from the opening in a direction opposite the ground pins. The antenna connector is secured to the printed circuit board by conductively securing the one or more ground pins and the pin portion to the printed circuit board. The printed circuit board and the antenna connector are positioned relative to a frame such that the antenna connector is disposed in a recess in the frame, the recess having the general shape of the antenna connector. The antenna connector is secured relative to the frame by a threaded fastener, the threaded fastener extending through an opening in the frame and into the opening in the flange. At least one of the opening in the frame and the opening in the flange is threaded. An antenna having a corresponding coaxial pin member is rotatably secured to the coaxial pin member of the antenna connector.

BRIEF DESCRIPTION OF THE DRAWINGS

The present invention can be further understood with reference to the following description in conjunction with the appended drawings, wherein like elements are provided with the same reference numerals. In the drawings.

DETAILED DESCRIPTION OF THE PREFERRED EMBODIMENT

Figure 1:
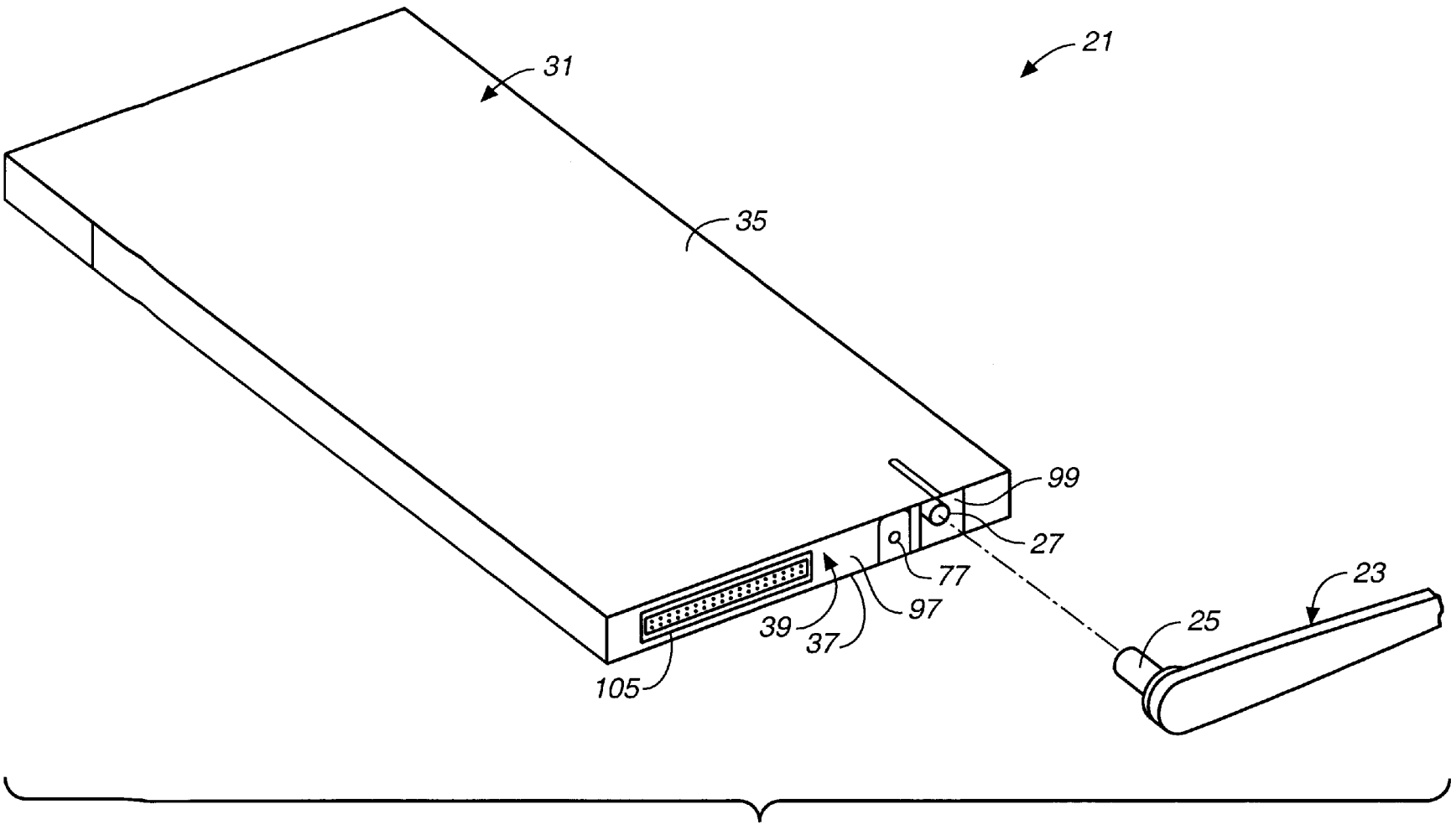
FIG. 1 is a perspective view of an electrical device according to an embodiment of the present invention, showing an antenna detached from the electrical device.
Figure 2:
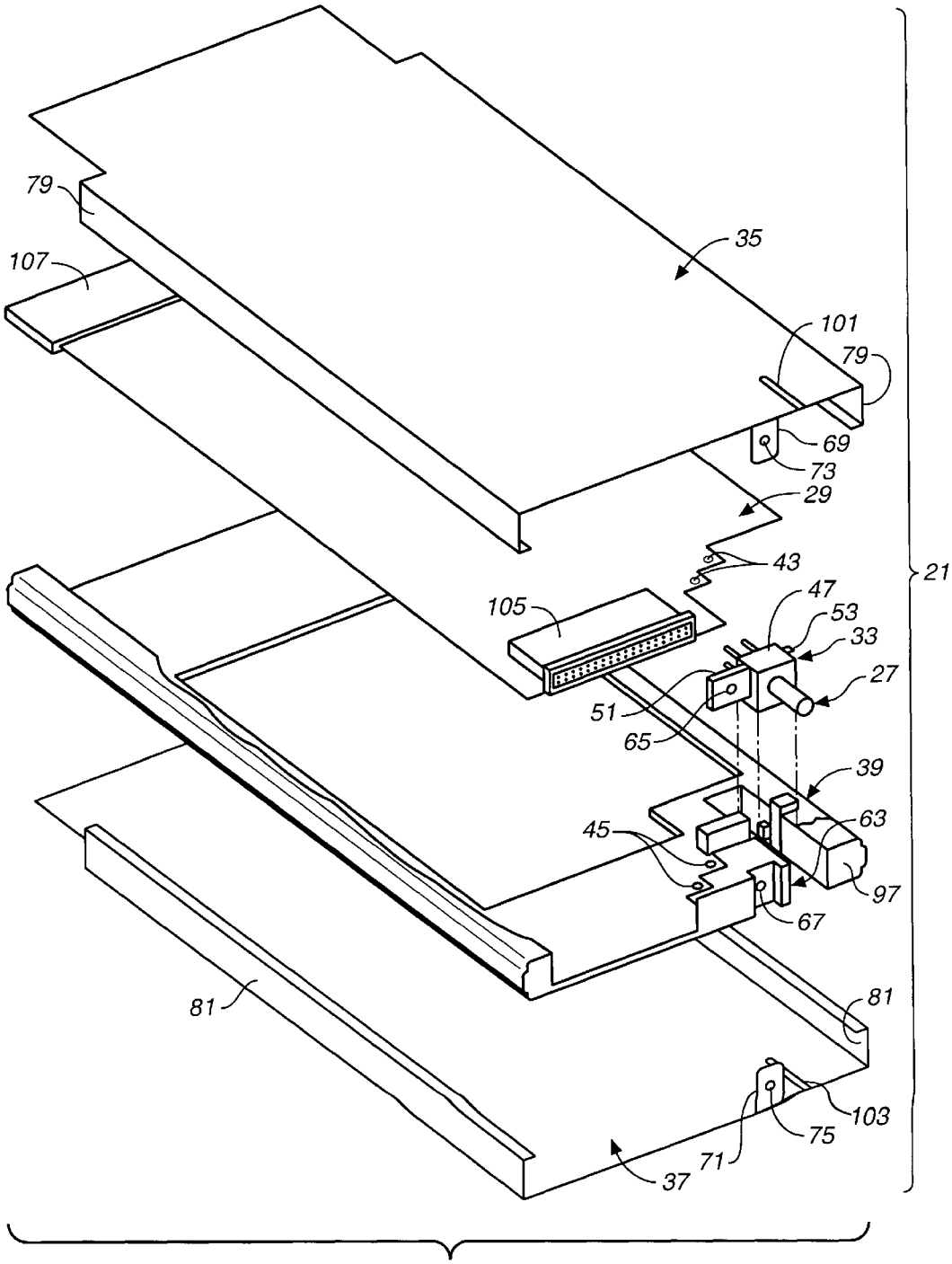
FIG. 2 is an exploded perspective view of the electrical device of FIG. 1, shown without the antenna.

An electrical device 21 according to an embodiment of the present invention is shown in FIG. 1, and in an exploded view in FIG. 2. As seen in FIG. 1, the electrical device 21 includes a rotatable antenna 23 (shown detached from the electrical device). The antenna 23 has a first or female coaxial pin member 25 that attaches to a second or male coaxial pin member 27 secured to a printed circuit board 29 (see FIG. 2) disposed inside of the housing 31 of the electrical device by an antenna connector 33 (see FIG. 2).

Figure 3:
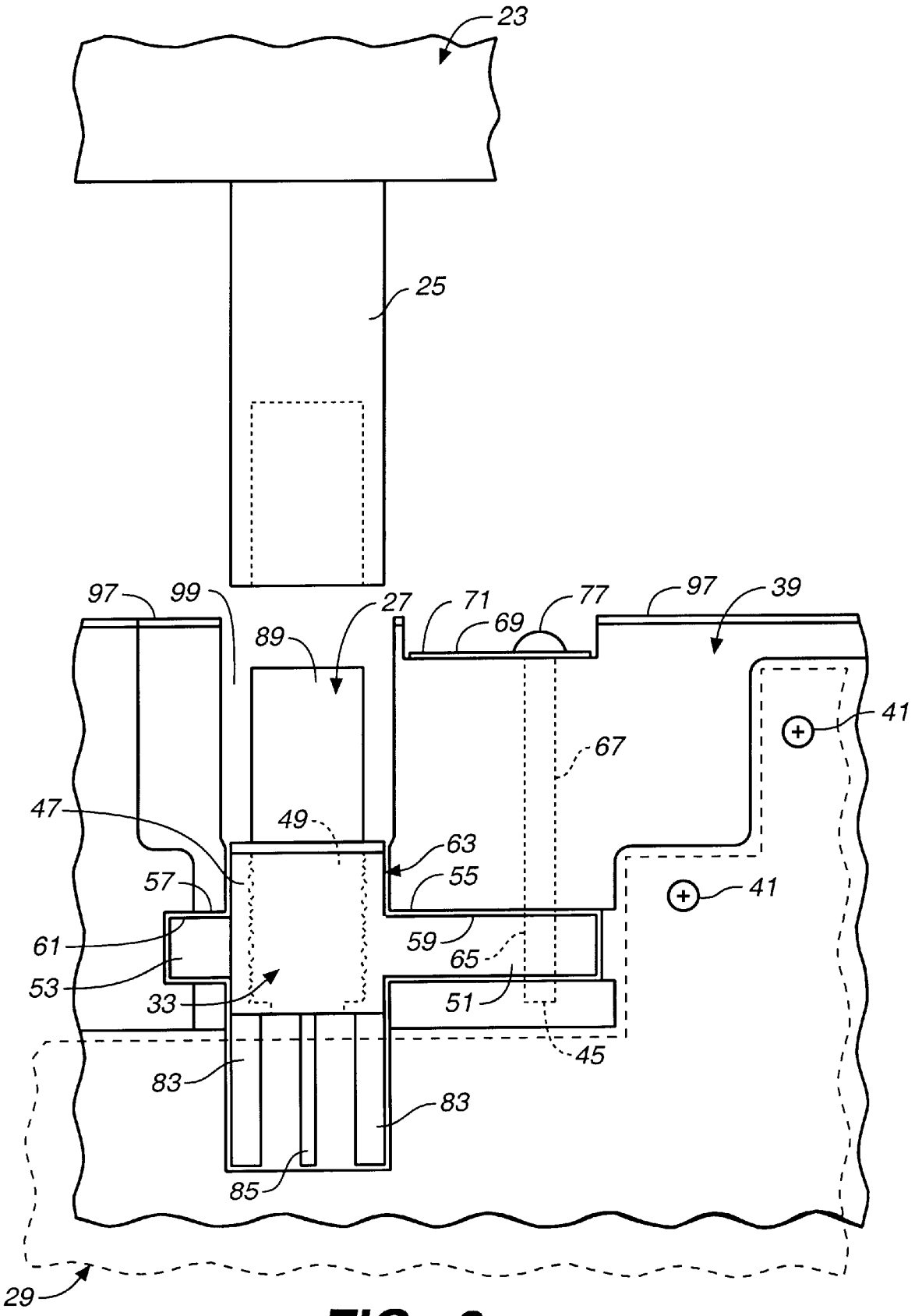
FIG. 3 is a partial view of an antenna, an antenna connector, and a frame according to an embodiment of the present invention, showing a printed circuit board in phantom.

As seen in FIGS. 1 and 2, the housing 31 preferably includes a top part 35, a bottom part 37, and a frame 39, all of which are preferably formed of conductive material, such as metallic material. As seen in FIG. 2, the printed circuit board 29 is disposed inside of the housing 31. As seen in FIG. 3, the printed circuit board 29 (shown in phantom by dotted lines) is fixed to the frame 39 by screws 41 that extend through holes 43 (seen in FIG. 2) in the printed circuit board into threaded holes 45 (seen in FIG. 2) in the frame.

Figure 4A:
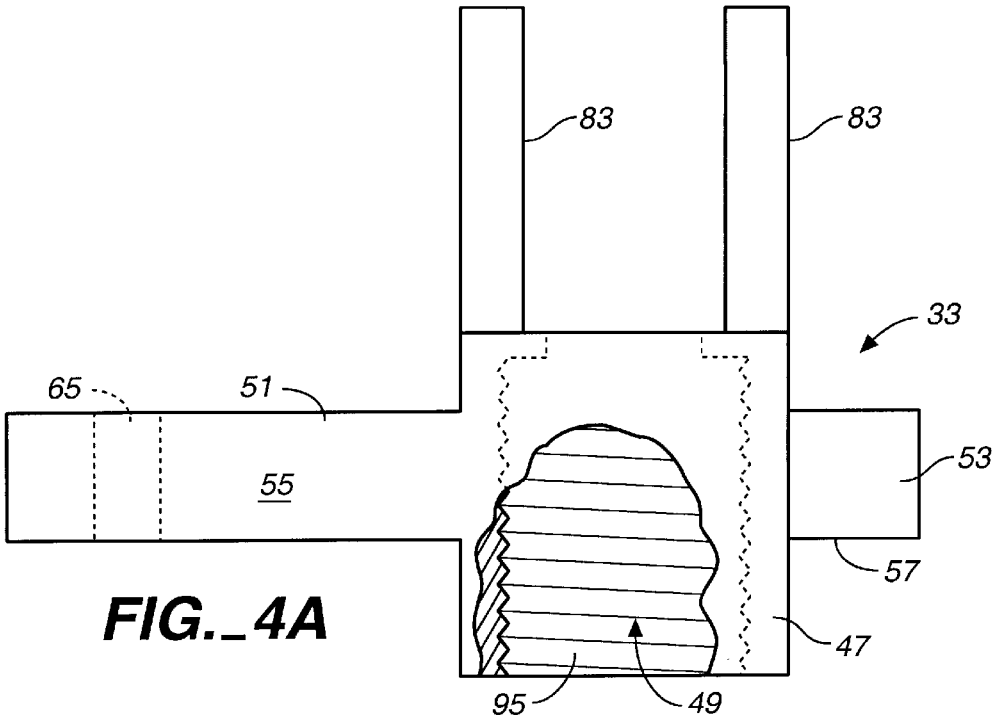
FIG. 4A is a top, partially broken view.
Figure 4B:
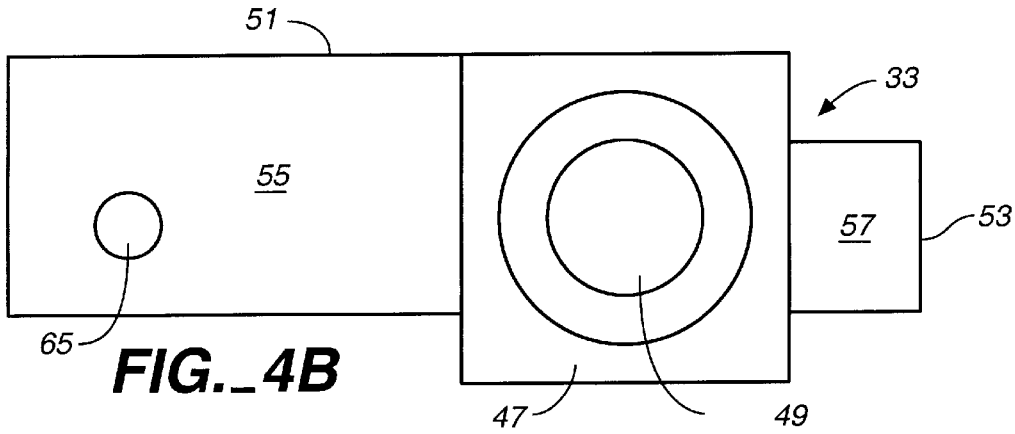
FIG. 4B is a front view.
Figure 4C:
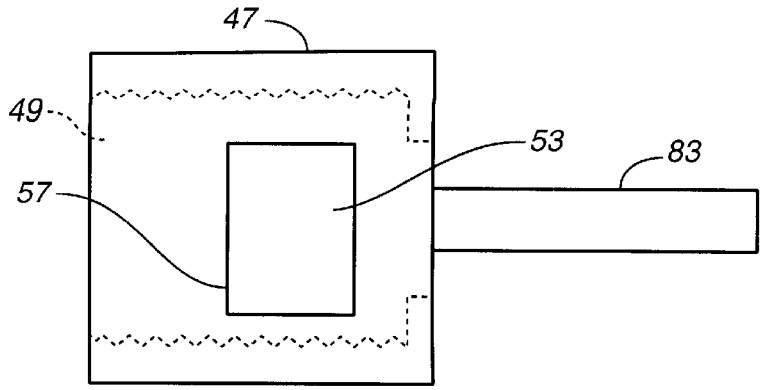
FIG. 4C is a side view of an antenna connector according to an embodiment of the present invention, shown without a male coaxial pin member.

As seen in FIGS. 4A–4C, which show the antenna connector 33 without the male pin connector member 27, the antenna connector includes a conductive body portion 47 having an opening 49 extending therethrough. As seen in FIGS. 4A and 4B, first and second flanges preferably 51 and 53 extend from opposite sides of the body portion 47. If desired or necessary, the antenna connector 33 can be provided with only a single flange, or with more than two flanges, depending upon the application for the antenna connector. The first and second flanges 51 and 53 have surfaces 55 and 57, respectively, which are preferably coplanar so that they can both abut against similarly coplanar surfaces 59 and 61, respectively, of a recess 63 of the frame 39 (seen in FIG. 3). As seen in FIG. 3, the recess 63 of the frame 39 is preferably generally complementary in shape to the shape of the antenna connector 33 such that the antenna connector is easily insertable in and removable from the recess. The flanges 51 and 53 preferably extend in a direction substantially perpendicular to a direction of the opening 49 of the body portion 47, however, if desired or necessary, the flanges and/or the surfaces 55 and 57 may be non-coplanar, as desired or necessary, provided the surfaces 59 and 61 of the frame 39 are similarly non-coplanar.

The first and second flanges 51 and 53 may be the same length, or may be of different lengths, as shown in FIGS. 4A and 4B, as desired or necessary for fitting the antenna connector into a recess within a recess 63 of a frame 39 having particular spatial requirements. At least one, and, if desired or necessary, both, of the first and second flanges 51 and/or 53 have an opening 65 therein. As seen in FIG. 3, the frame 39 is also formed with an opening 67 that aligns with the opening 65 of the antenna connector 33. As seen in FIG. 2, the top part 35 and the bottom part 37 are formed with extending portions 69 and 71, respectively, that each have holes 73 and 75, respectively, formed therein. When the top part 35 and the bottom part 37 are positioned around the frame 39, the holes 73 and 75 align with the opening 67 in the frame and the opening 65 in at least one of the flanges 51 and 53 of the antenna connector 33. At least one, and preferably both, of the opening 65 in the at least one of the flanges 51 and 53 and the opening 67 in the frame 39 are threaded. As seen in FIG. 3, a single fastener 77 extends through the holes 73 and 75 (not numbered in FIG. 3) and the openings 65 and 67 and secures the antenna connector 33 relative to the frame 39, preferably such that the surfaces 55 and 57 of the first and second flanges 51 and 53, respectively, abut against the surfaces 59 and 61, respectively, of the frame, and such that the top part 35 and the bottom part 37 are secured relative to the frame. As seen in FIG. 2, the top part 35 and the bottom part 37 preferably have side flanges 79 and 81, respectively, that are sufficiently flexible to be bent around the frame 39 and serve to assist in securing the top part and the bottom part relative to the frame.

Figure 5A:
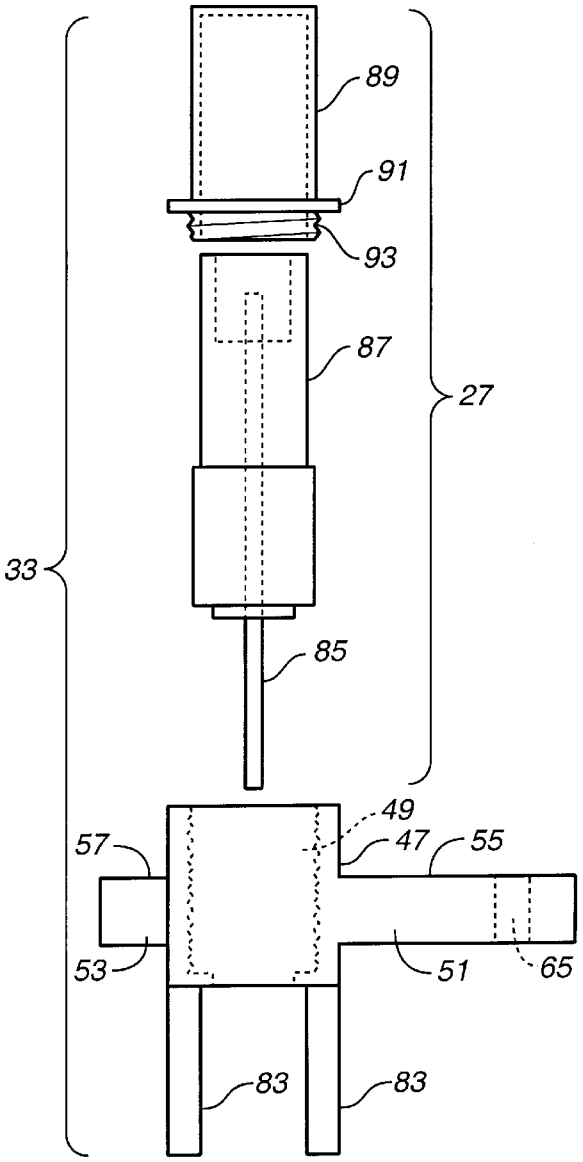
FIG. 5A is an exploded top view.
Figure 5B:
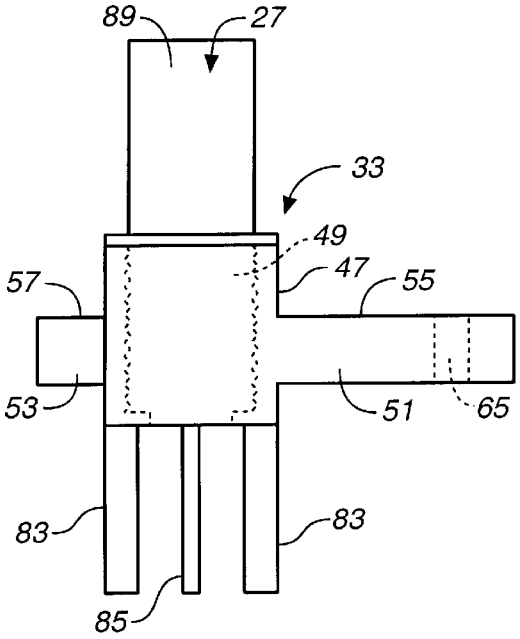
FIG. 5B is a top view of an antenna connector according to an embodiment of the present invention.

As seen in FIGS. 4A–4C, one or more, preferably two ground pins 83 extend from the body portion 47 in a direction substantially perpendicular to the first and second flanges 51 and 53 and parallel to the direction of the axis of the opening 49 in the body portion. As seen with reference to FIGS. 5A and 5B, the male coaxial pin member 27 extends through the opening 49 in the antenna connector 33. As seen in FIG. 5A, the male coaxial pin member 27 includes a central conductive pin 85 which, when the male coaxial pin member is disposed in the opening 49 as seen in FIG. 5B, extends rearwardly from the opening 49 in the direction of the ground pins 83 as well as forwardly from the opening. As seen in FIG. 5A, the male coaxial pin member 27 also includes an insulating sleeve portion 87 that insulates the central pin from the body portion 47, and an outer conductor 89 that receives part of the sleeve portion. The outer conductor 89 makes secure electrical and mechanical contact with the surface of the opening 49 in the body 47 of the antenna connector 33. Although many methods of making this connection are possible for one skilled in the art, according to a preferred embodiment, the outer conductor 89 includes a flange 91 and a threaded portion 93. The threaded portion 93 mates with internal threads 95 on the surface of the opening 49 in the antenna connector 33 to secure the male coaxial pin member 27 relative to the antenna connector.

As seen with reference to FIG. 3, after securing the male coaxial pin member 27 in the antenna connector 33, the printed circuit board 29 is soldered, brazed or otherwise conductively bonded to the ground pins 83 and the pin portion 85 of the male coaxial pin member in a suitable fashion. After securing the printed circuit board 29 to the central conductor 85 of the male coaxial pin member 27, the antenna connector 33 is positioned in the recess 63 in the frame 39 and the printed circuit board 29 is secured to the frame by means of the screws 41 that extend through the holes 43 in the printed circuit board into the threaded holes 45 in the frame (seen in FIG. 2). The top part 35 and the bottom part 37 are then attached around the frame 39 and secured to the frame and the antenna connector 33 by the fastener 77.

The recess 63 of the frame 39 is preferably configured such that the portion of the outer conductor 89 of the male coaxial pin member 27 extends to a point substantially flush with or slightly recessed from an exterior portion 97 of the frame and is disposed in a recess 99 defined on left and right sides by the frame and on the top and bottom by the top part 35 and the bottom part 37. As seen in FIG. 2, the top part 35 and the bottom part 37 preferably have slits 101 and 103, respectively, formed therein. When the female coaxial pin member 25 is attached over the outer conductor 89 of the male coaxial pin member 27, part of the female coaxial pin member is disposed in the recess 99 and is in sliding contact with the top part 35 and the bottom part 37. The slits 101 and 103 facilitate sliding of the female coaxial pin member 25 relative to the top part 35 and bottom part 37 while also facilitating providing sufficient compressive force on the female coaxial pin member to cause the female coaxial pin member and the rest of the antenna 23 to stay in position when rotated relative to the housing 31.

An important aspect of this invention is the role played by the flanges 51 and, if provided, 53 in ensuring electrical contact so as to make the frame 39, the top portion 35, and the bottom portion 37 a well-shielded enclosure providing protection to circuitry on the printed circuit board 29 from interference generated outside the device 21, and also providing protection against radiated energy from circuitry on the printed circuit board with electronic equipment outside of the device 21 (which interference could make operation of the device unlawful). The electrical connection is effected by the secure contact of the female member 25 to the outer conductor 89 of the male coaxial pin member 27 which, in turn, is electrically connected to the body 47 of the antenna connector 33 and to the flanges 51 and 53. The fastener 77 ensures that the frame, the printed circuit board and the top portion 35 and the bottom portion 37 are all electrically joined.

The body portion 47, the first flange 51, the second flange 53, and the ground pins 83 of the antenna connector 33 are preferably formed as a single piece, preferably from an alloy such as $ZnAl_4Cu$. The pin portion 85 and the outer conductor 89 are preferably copper alloys. The insulating sleeve portion 87 is preferably a PTFE insulator.

As seen in FIG. 2, the printed circuit board 29 preferably includes pin connectors 105 and 107 for electrically connecting the printed circuit board to other electrical elements or circuitry.

It will be appreciated that the foregoing describes a presently preferred embodiment of an electrical device having an antenna connector and that other configurations for the electrical device and antenna connector can be achieved. The antenna connector according to the present invention, particularly when coupled with a complementary frame, is intended to absorb stresses caused by rotating an antenna that would otherwise be absorbed by the connection between a coaxial pin and a printed circuit board.

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. An antenna connector, comprising:

a body portion having an opening extending therethrough;

a flange extending from a side of the body portion in a direction substantially perpendicular to a direction of an axis of the opening;

one or more ground pins extending from another side of the body portion in the direction of the axis of the opening; and a coaxial pin member extending through and secured to the opening in the body portion, the coaxial pin member including a pin portion extending outwardly from the opening in a direction of and parallel to the one or more ground pins.

2. The antenna connector as set forth in claim 1, wherein the body portion, the flange, and the one or more ground pins are formed as a single piece.

3. The antenna connector as set forth in claim 1, wherein the flange includes an opening extending therethrough, the opening being parallel to the opening extending through the body portion.

4. The antenna connector as set forth in claim 1, wherein the opening in the body portion includes internal threads and the coaxial pin member includes external threads that mate with the internal threads of the opening in the body.

5. The antenna connector as set forth in claim 1, further comprising a second flange extending from the body portion in a direction substantially parallel to the direction of the flange.

6. An electrical device, comprising:

an antenna, the antenna having a first coaxial pin member;

a printed circuit board;

a frame, the printed circuit board being attached to the frame, the frame including a recess;

an antenna connector, the antenna connector including a conductive body portion having an opening extending therethrough, a flange extending from a side of the body portion in a direction substantially perpendicular to a direction of the opening, the flange having an opening therein, one or more ground pins extending from the body portion in a direction substantially perpendicular to the flange, a second coaxial pin member extending through and secured to the opening in the body portion, the second coaxial pin member including a pin portion extending outwardly from the opening in a direction of and parallel to the one or more ground pins, and an outer conductor extending outwardly from the opening in a direction opposite the ground pins, the antenna connector being received in the recess of the frame and aligning with the frame such that the opening in the flange aligns with an opening in the frame, at least one of the opening in the flange and the opening in the frame being threaded; and a threaded fastener, the threaded fastener extending through the opening in the frame and the opening in the flange and securing the flange of the antenna connector to a corresponding surface of the recess in the frame, wherein the pin portion and the ground pins are conductively secured to the printed circuit board, and wherein the first coaxial pin member is detachably and rotatably secured to the second coaxial pin member.

7. The electrical device as set forth in claim 6, wherein the body portion, the flange, and the ground pins are formed as a single piece.

8. The electrical device as set forth in claim 6, wherein the flange includes an opening extending therethrough, the opening being parallel to the opening extending through the body portion.

9. The electrical device as set forth in claim 6, further comprising a second flange extending from the body portion in a direction substantially parallel to the direction of the flange, the second flange contacting a second surface of the recess in the frame.

10. The electrical device as set forth in claim 6, further comprising a plurality of flanges extending from the body portion, the plurality of flanges contacting a plurality of corresponding surfaces of the recess in the frame.

11. The electrical device as set forth in claim 6, wherein a continuous electrical path is maintained between the antenna, the antenna connector, the printed circuit board, the frame and a conductive housing around the printed circuit board, the frame, and the antenna connector, the electrical path providing shielding against electromagnetic emissions entering or leaving the device.

12. A method for making an electrical device, comprising the steps of:

an antenna, the antenna having a first coaxial pin member;

a frame, a printed circuit board being attached to the frame, the frame including a recess;

securing, to the printed circuit board, an antenna connector, the antenna connector including a conductive body portion having an opening extending therethrough, a flange extending from a side of the body portion, the flange having an opening therein, one or more ground pins extending from the body portion in a direction substantially perpendicular to the flange, and a coaxial pin member extending through and secured to the opening in the body portion, the coaxial pin member including a pin portion extending outwardly from the opening in a direction of and parallel to the one or more ground pins, and an outer conductor extending outwardly from the opening in a direction opposite the ground pins, by conductively securing the one or more ground pins and the pin portion to the printed circuit board;

positioning the printed circuit board and the antenna connector relative to a frame such that the antenna connector is disposed in a recess in the frame, the recess having the general shape of the antenna connector;

securing the antenna connector relative to the frame by a threaded fastener, the threaded fastener extending through an opening in the frame and into the opening in the flange, at least one of the opening in the flange and the opening in the frame being threaded; and rotatably attaching an antenna having a corresponding coaxial pin member to the coaxial pin member of the antenna connector.

13. The method as set forth in claim 12, comprising the further step of securing the printed circuit board to the frame after securing the printed circuit board to the antenna connector.

14. The method as set forth in claim 12, comprising the further step of attaching a top part and a bottom part around the frame, the printed circuit board, and the antenna connector.

15. The method as set forth in claim 12, comprising the further step of positioning the antenna connector, the frame, and the printed circuit board inside of a conductive housing, the conductive housing, the antenna connector, the frame, and the printed circuit board being secured relative to one another such that a continuous electrical path is formed to provide shielding against electromagnetic emissions entering or leaving the device.

* * * * *